US005478269A

United States Patent [19]

Wolfram

[11] Patent Number: 5,478,269

[45] Date of Patent: Dec. 26, 1995

[54] TOY FIGURE HAVING GRASPING CLAW

[75] Inventor: David G. Wolfram, Hermosa Beach, Calif.

[73] Assignee: Mattel, Inc., El Segundo, Calif.

[21] Appl. No.: 385,853

[22] Filed: Feb. 9, 1995

[51] Int. Cl.[6] ..... A63H 3/20

[52] U.S. Cl. ..... 446/330; 446/390

[58] Field of Search ..... 446/330, 334–336, 446/390, 365, 359, 304, 298, 340

[56] References Cited

U.S. PATENT DOCUMENTS

| | | | |
|---|---|---|---|
| D. 268,222 | 3/1983 | Chen . | |
| D. 330,575 | 10/1992 | Kupperman . | |
| D. 333,854 | 3/1993 | Kupperman | 446/365 X |
| D. 334,782 | 4/1993 | Kupperman | 446/365 X |
| D. 334,955 | 4/1993 | Kupperman | 446/365 X |
| 961,812 | 6/1910 | Siegel | 446/391 X |
| 1,028,068 | 5/1912 | Hamley | 446/329 |
| 2,762,163 | 9/1956 | Stein | 446/329 |
| 2,795,896 | 6/1957 | Snyder | 446/329 |
| 3,594,947 | 7/1971 | Hartling et al. | 446/390 X |
| 3,696,553 | 10/1972 | Lewis et al. | 446/390 X |
| 4,561,854 | 12/1985 | Amici et al. | 446/304 |
| 4,579,541 | 4/1986 | Kulesza et al. | 446/365 X |
| 4,585,425 | 4/1986 | Amici et al. | 446/365 X |
| 4,605,382 | 8/1986 | Cook et al. | 446/330 |
| 4,608,025 | 8/1986 | Amici et al. | 446/298 |
| 4,622,020 | 11/1986 | Amici et al. | 446/298 |
| 4,654,018 | 3/1987 | Farrington et al. | 446/330 X |
| 4,687,457 | 8/1987 | Milner | 446/329 X |
| 4,944,710 | 7/1990 | Sommers | 446/329 |
| 5,080,626 | 1/1992 | Maddi | 446/365 X |
| 5,378,188 | 1/1995 | Clark | 446/330 |

*Primary Examiner*—Mickey Yo
*Attorney, Agent, or Firm*—Roy A. Ekstrand

[57] ABSTRACT

A toy figure includes a torso supporting a pair of pivotally secured legs and a pair of pivotally secured arms. One of the legs is further pivotable in an inward direction and is coupled to a pivotal lever supported within the torso interior. One of the arms is coupled to a grasping claw having a fixed jaw and a movable jaw pivotal with respect thereto. A cable mechanism is coupled between the movable jaw and the internally supported lever to provide opening and closing of the grasping claw in response to inward motion of one leg with respect to the torso. The opening and closing of the grasping claw is independent of the pivotal motion of the arm and the rotational motion of the grasping claw and is instead solely dependent upon the inward motion of the coupled leg.

10 Claims, 2 Drawing Sheets

TOY FIGURE HAVING GRASPING CLAW

FIELD OF THE INVENTION

This invention relates generally to toys figures and particularly to those having articulating appendages or the like.

BACKGROUND OF THE INVENTION

Toy figures are extremely pervasive through the toy art and have been provided in a virtually endless variety of appearances, shapes and sizes. These various toy figures have included human-like replicas, monsters, fanciful creatures, and cartoon figures as well as other types of figures. While the variety of such toy figures is virtually endless, most share the common play pattern of providing a handheld figure which the child user is able to manipulate and move about while imagining all sorts of play scenarios. To add further interest to such toy figures, practitioners in the art have improved toy figures to include appendages and limbs which are movable upon the figure's torso as well as other articulated features such as closing jaws or the like. In still other variants, toy figures have been provided which include various types of miniature weapons such as projectile launchers or the like.

In a related art, practitioners have provided a variety of puppets which function with much the same play value as toy figures. While puppets generally describe both handheld "glove-like" hand puppets as well as string-controlled marionettes, those most similar to the present invention are generally referred to as hand puppets. Such hand puppets include a glove-like body within which the user places a hand and through finger and thumb manipulation provides animation for the puppet.

U.S. Pat. No. 4,561,854 issued to Amici, et al. sets forth a CREATURE WITH SNAP-ACTION JAW having a pair of body members defining a body cavity together with a plurality of supporting appendages. The lower body portion supports a fixed jaw while a pivotally supported head portion is secured to the body and supports a movable upper jaw. A spring-driven trigger mechanism provides snap-action closure of the jaw.

U.S. Pat. No. 4,654,018 issued to Farrington, et al. sets forth a FIGURE TOY WITH LAUNCHING MECHANISM FOR CONCEALED FLYING ELEMENT having an insect-like body defining a rear cavity within which a rotatable winged projectile is secured. A launching apparatus within the figure's abdomen provides rotational motion of the winged projectile causing it to be lifted from the main body.

U.S. Pat. No. 4,579,541 issued to Kulesza, et al. sets forth MECHANICAL ACTION MONSTER ROCK TOYS having one or more elements pivotally coupled to a generally planar base for movement to various positions. The elements are configured to provide a rock-like appearance to the figure.

U.S. Pat. Des. Nos. 333,854; 334,782; 334,955; and 330,575 all issued to Kupperman set forth similar designs for a shark toy figure.

U.S. Pat. No. 5,080,626 issued to Maddi, sets forth an ANIMAL PUPPET having an appearance resembling a dinosaur and defining a hand receiving cavity therein. The figure includes articulated upper and lower jaws which are manipulated by the user's hand in a hand puppet action.

U.S. Pat. No. 4,944,710 issued to Sommers set forth a PUPPET MOUTH CONSTRUCTION having a hand puppet body defining a fanciful dog-like face and supporting articulated upper and lower jaw portions. A cavity within the puppet receives the user's hands to facilitate manipulation of the upper and lower jaws.

U.S. Pat. No. 4,687,457 issued to Milner sets forth a HAND-HELD PUPPET WITH PSEUDO-VOICE GENERATION having a puppet including a hand controllable upper and lower beak together with a sound circuit controlled in response to beak motions induced by the user's hand within the puppet.

U.S. Pat. No. 4,622,020 issued to Amici, et al. sets forth a GLOVE PUPPET FIGURE ASSEMBLY AND POWERED WING DRIVE MECHANISM having a glove puppet having a body which generally resembles a winged insect supporting a riding human-like figure together with a plurality of articulated wings.

U.S. Pat. No. 4,608,025 issued to Amici, et al. sets forth a GLOVE PUPPET FIGURE ASSEMBLY WITH ARTICULATED HEAD COMPONENTS having a hand puppet having a body generally resembling a winged insect and supporting a plurality of extending wings, a movable jaw and a toy figure riding the puppet. The insect's jaws are movable in response to hand manipulation of the user.

U.S. Pat. No. 4,585,425 issued to Amici, et al. sets forth a GLOVE PUPPET ASSEMBLY WITH FINGER ACTUATED CLAWS having an insect-like body supporting a rider and having a plurality of extending claws which are movable in response to the manipulation by the user.

U.S. Pat. No. 2,762,163 issued to Stein sets forth a PUPPET DOLL having a puppet body for receiving a user's hand to articulate the head and facial expressions of the puppet.

U.S. Pat. Des. No. 268,222 issued to Chen sets forth a GLOVE having a general appearance resembling a shark or the like.

U.S. Pat. No. 961,812 issued to Siegel sets forth a FIGURE TOY having a hand puppet body resembling a dog or the like and having a finger movable jaw mechanism within the head thereof.

U.S. Pat. Nos. 3,034,255 issued to Bacon; 2,795,896 issued to Snyder; and 1,028,068 issued to Hamley set forth examples of typical hand actuated puppets.

While the foregoing described prior art devices have provided improvement in the art and have in some instances enjoyed commercial success, there remains nonetheless a continuing need in the art for evermore improved, interesting and exciting toy figures.

SUMMARY OF THE INVENTION

Accordingly, it is a general object of the present invention to provide an improved toy figure. It is a more particular object of the present invention to provide an improved toy figure having a grasping claw which is operative in a variety of appendage positions.

In accordance with the present invention, there is provided a toy figure comprising: a body having an interior cavity formed therein; a plurality of appendages coupled to the body; first means for pivotally supporting a first one of the appendages upon the body for first and second directions of motion; second means for pivotally supporting a second one of the appendages upon the body; a fixed jaw rotatably coupled to the second one of the appendages; a movable jaw pivotally coupled to the fixed jaw movable between open and closed positions; first spring means coupled to the fixed jaw and the movable jaw urging the movable jaw toward the open position; an arm pivotally supported within the interior cavity having a first end coupled to the first one of the appendages and a second end; a flexible member connected to the movable jaw and the second end of the arm; and second spring means coupled to the arm urging the arm and the first one of the appendages in the first pivotal direction of motion, whereby the movable jaw is moved from the open position toward the closed position as the first one of the appendages is pivoted in the second pivotal direction of motion.

BRIEF DESCRIPTIONS OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a side elevation view of a toy figure constructed in accordance with the present invention; and FIG. 2 sets forth a partially section front view of a toy figure constructed in accordance with the present invention.

DESCRIPTION OF THE PREFERRED EMBODIMENT

Figure 1:
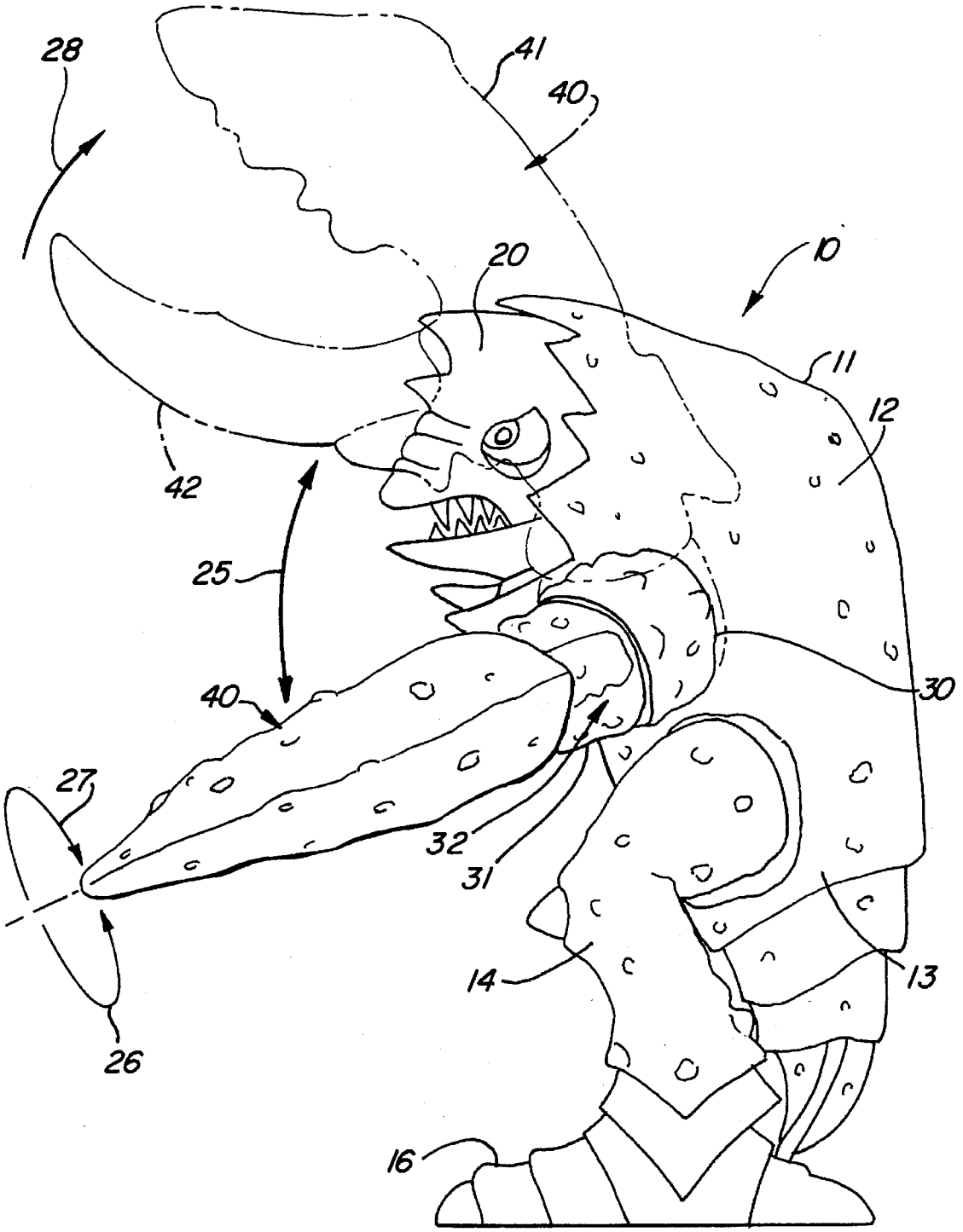

FIG. 1 sets forth a side elevation view of a toy figure constructed in accordance with the present invention and generally referenced by numeral 10. FIG. 10 includes a body 11 formed of a torso 12 having a lower torso 13 extending downwardly therefrom. Body 11 further includes a pair of legs 14 and 15 (the latter seen in FIG. 2) secured to lower torso 13 in the manner described below. Legs 14 and 15 terminate in supporting feet 16 and 17 (the latter seen in FIG. 2). Body 11 further supports a head 20 having a monster-like face depicted thereon. In accordance with the present invention and as is described below in greater detail, body 11 further includes an upper left arm 31 pivotally secured to torso 12 at a left shoulder joint 30. Upper left arm 31 supports a left claw 40 pivotally secured at a left claw joint 32, the structure of which is set forth below in greater detail. However, suffice it note here that left claw 40 is pivotably movable or rotatable about left claw joint 32 with respect to upper arm 31 in the manner indicated by arrows 26 and 27 in either direction.

Figure 2:
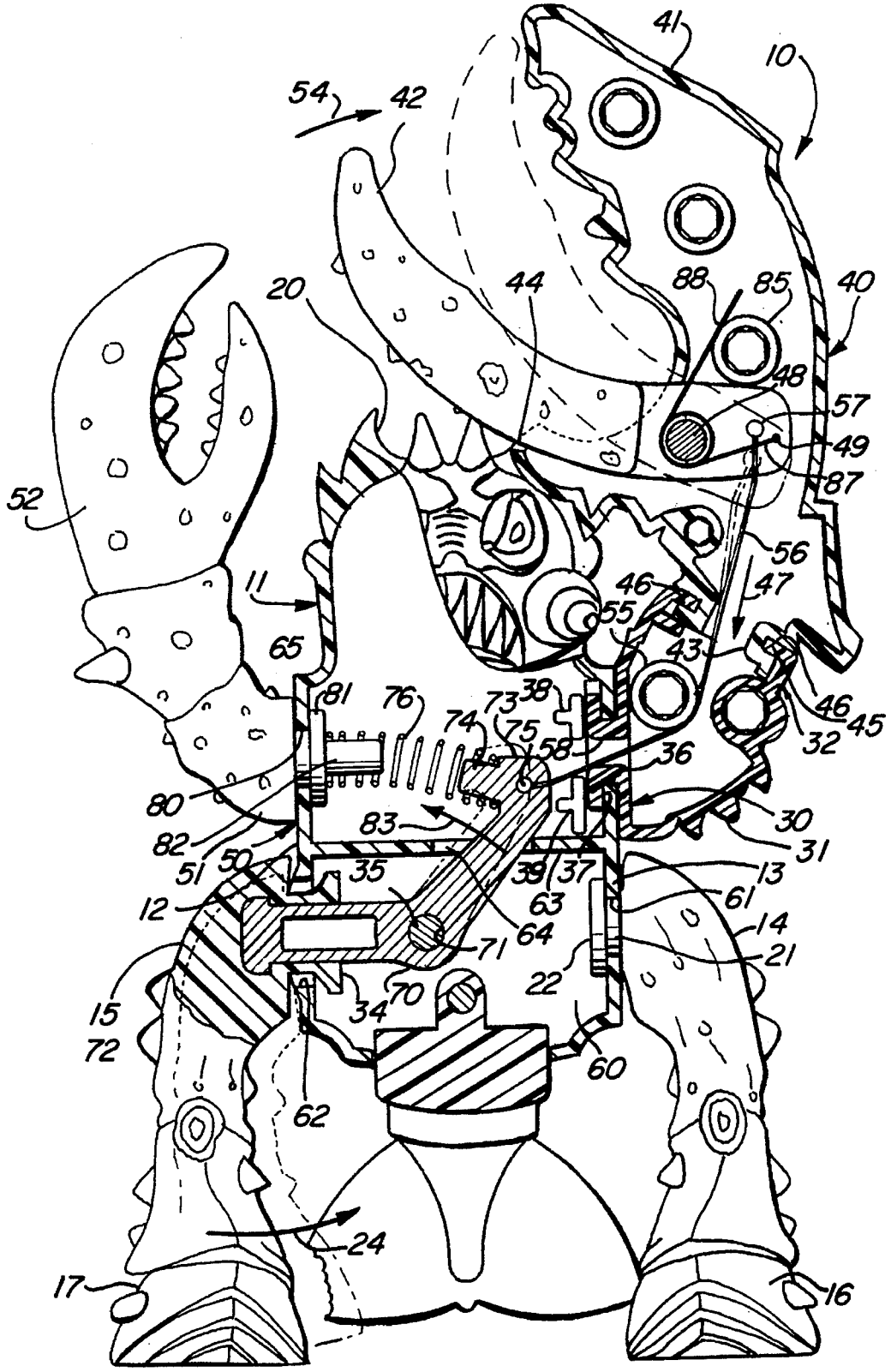

As is better seen with temporary reference to FIG. 2, left claw 40 includes a fixed jaw 41 and a movable jaw 42 pivotally secured thereto. As is also better seen with temporary reference to FIG. 2, body 11 includes a right arm 51 pivotally secured to torso 12 at a shoulder joint 50 and supporting a right claw 52.

Returning to FIG. 1, left shoulder joint 30 comprises a pivotal joint permitting upper left arm 31 and claw 40 to be pivotally moved up and down in the directions indicated by arrows 25. For example, FIG. 1 shows left claw 40 and upper arm 31 in solid-line depiction at a lowered pivotal position and in dashed-line position at a raised pivotal position. It will be apparent to those skilled in art from the descriptions set forth below in greater detail that the pivotal motion of left upper arm 31 and claw 40 about shoulder joint 30 may, if desired, be virtually unlimited in its extent. In further accordance with the present invention and, as is described below in greater detail, left claw 40 is pivotable or rotatable with respect to upper arm 31 as indicated by arrows 26 and 27 to be position able in virtually any angular relationship. For example, in the solid-line depiction, claw 40 is positioned in a generally horizontal position while in the dashed-line representation shown in FIG. 1, left claw 40 is positioned in a vertical orientation. In accordance with the present invention, it will be understood that in its preferred form, left claw 40 is fully rotatable and is not limited to the vertical or horizontal planes for its position.

In further accordance with the present invention, movable jaw 42 is, by means set forth below in greater detail, pivotable with respect to fixed jaw 41 from the open position shown in FIG. 1 to a closed position as movable jaw 42 pivots in the direction indicated by arrow 28. In further accordance with the present invention, the claw operating mechanism of toy FIG. 10 is operative regardless of the positions of left upper arm 31 with respect to torso 12 and the pivoting positions of claw 40 with respect to left upper arm 31. Thus, regardless of the position of upper arm 31 and claw 40, the claw control mechanism set forth below operates with equal facility to close movable jaw 42 against fixed jaw 41. Thus, the mechanism is described below in greater detail in conjunction with FIG. 2. However, suffice it to note here with temporary reference to FIG. 2, that the closure mechanism is operated as leg 15 is pivoted inwardly in the direction indicated by arrow 24. Thus, the present invention toy figure provides an entertaining and amusing figure which utilizes a closable claw operative in virtually any position of the claw or supporting arm giving the user a freedom of use heretofore unrealized in articulated limb toy figures. It should be noted that while toy FIG. 10 is shown for purposes of illustration in FIGS. 1 and 2 to replicate a fanciful "lobster-like" monster, the present invention is applicable to virtually any toy figure regardless of its appearance or aesthetic characteristics. The essential feature of the present invention is the provision of an operative claw closure mechanism which is virtually uneffected by the angular position and rotational position of the claw and its supporting arm. It is a further advantage of the present invention that the claw operating structure is extremely simple and is nonetheless durable and effective.

FIG. 2 sets forth a partially sectioned view of toy FIG. 10 showing the articulated claw in the raised position. The depiction in FIG. 2 is a front view of the present invention toy figure which has been partially sectioned to reveal the operative mechanism used in articulating the closable claw.

More specifically, toy FIG. 10 includes a body 11 having a torso 12 which in turn defines an interior cavity 65. Body 11 further includes a downwardly extending torso 13 having an interior cavity 60 formed therein. A head 20 is formed on the upper portion of torso 12. An interior wall 63 having an aperture 64 formed therein separates interior cavities 60 and 65. Torso 12 defines an aperture 36 at shoulder joint 30 and an aperture 80 at shoulder joint 50. A right arm 51 includes an attachment post 81 extending through aperture 80 and terminating in an inwardly extending spring post 82. Right arm 51 further includes a right claw 52 which is not articulated.

Left upper arm 31 extends through aperture 36 of torso 12 and defines a groove 37 which receives the interior portion of torso 12 forming aperture 36. A pair of guides 38 and 39 are formed within interior cavity 65 to further secure the position of left arm 31. Thus, left arm 31 is rotatably secured to torso 12 at shoulder joint 30. As described above, left arm 31 is rotatably secured to claw 40 at left claw joint 32. More specifically, left upper arm 31 defines an inwardly extending lip 45 which is received within a groove 46 formed at the lower end of fixed jaw 41 of claw 40. Left upper arm 31 further includes a post 55 and an aperture 58.

Claw 40 includes a fixed jaw 41 having an aperture 44 formed therein. Fixed jaw 41 further defines an aperture 43 at the lower end thereof and supports a plurality of attachment posts such as post 85. In addition, fixed jaw 41 includes a post 48. Claw 40 further includes a movable jaw 42 having a lower end extending through aperture 44 and defining an aperture (not shown) which receives post 48 to pivotally secure movable jaw 42 to fixed jaw 41. Movable jaw 42 further defines an aperture 49 and a cable attachment 57. A coil spring 86 defines an end 88 positioned against post 85 and an end 87 received within aperture 49. Spring 46 provides a spring force urging movable jaw 42 to the open position shown in solid-line representation in FIG. 2. Thus, under the urging of spring 86, the interior end of movable jaw 42 is urged against post 85.

Lower torso 13 defines an aperture 61 on the left side thereof and an aperture 62 on the right side thereof. Leg 14 includes a supporting foot 16 and an inwardly extending post 21 which extends through aperture 61. Post 21 terminates in an enlarged head 22 which secures leg 14 to lower torso 13 in a pivotal attachment. Leg 15 includes a supporting foot 17 and an inwardly extending post 33. Post 33 extends through aperture 62 and is substantially smaller in diameter than aperture 62. Post 33 terminates in an enlarged head 34 which defines a diameter greater than aperture 62.

An arm 70 includes an end 72 pivotally coupled to post 33 of leg 15, an aperture 71, and an end 73. End 73 terminates in a post 74. A coil spring 76 is received upon and captivated between post 74 of arm 70 and post 82 of right arm 51. Arm 70 is pivotally secured to lower torso 13 by the extension of post 35 through aperture 71. The larger diameter of aperture 62 permits the pivotal motion of arm 70. End 73 of arm 70 extends through an aperture 64 formed in wall 63. Thus, the angular motion of arm 70 about post 35 is limited by the size of aperture 64 together with the relationship between the size of aperture 62 in lower torso 13 and the diameter of post 33 of leg 15. A flexible cable 56 has one end secured to end 73 of arm 70 through attachment 75 and the remaining end secured to movable jaw 42 at attachment 57. Cable 56 passes through aperture 58 in left arm 31 and bends about post 55. Thereafter, cable 56 passes through aperture 43 in fixed jaw 41 and extends to attachment 57.

In the embodiment in the present invention shown in FIG. 2, leg 14 is pivotable with respect to lower torso 13 as it pivots about post 21 while leg 15 is pivotable with respect to lower torso 13 as it pivots about end 72 of arm 70. In addition, leg 15 is pivotable with respect to lower torso 13 in the direction indicated by arrow 24 due to the larger diameter of aperture 62. This pivotal motion of leg 15 causes a corresponding pivotal motion of arm 70 about post 35. Spring 76 provides a compressive spring force which urges arm 70 in a pivoting direction away from post 82 in a clockwise rotation until end 73 contacts one side of aperture 64 in the position shown in solid-line representation in FIG. 2. Correspondingly, spring 86 provides a spring force which urges the interior end of movable jaw 42 toward post 85 thereby urging movable jaw 42 toward the open position shown in FIG. 2 and slightly tensioning cable 56.

Thus, with movable jaw 42 maintained in the open position, left arm 31 may be pivoted about shoulder joint 30 without altering the position of movable jaw 42. Similarly, the entire claw assembly 40 may be rotated about claw joint 32 without significantly effecting the open position of movable jaw 42. Thus, as described above, the user is able to position upper arm 31 and claw 40 as desired without altering the open position of movable jaw 42.

The closure of movable jaw 42 is accomplished by the application of an inwardly directed force upon leg 15 and foot 17 in the direction indicated by arrow 24. This inwardly directed force causes a corresponding pivotal motion of arm 70 in the direction indicated by arrow 83 which overcomes spring 76. As end 73 of arm 70 is moved inwardly due to pivotal motion of leg 15, cable 56 is drawn inwardly about post 55 which in turn overcomes the force of spring 86 and pivots movable jaw 42 toward closure against fixed jaw 41 in the direction indicated by arrow 54. As leg 15 continues to pivot inwardly, cable 56 is drawn fully and movable jaw 42 is pivoted in the direction of arrow 54 to the closed position shown in dashed-line representation. This closed position is maintained so long as leg 15 is held in the inwardly pivoted direction with respect to lower torso 13. Once leg 15 is released, however, spring 76 produces a spring force against end 73 of arm 70 pivoting arm 70 in a clockwise direction about post 35 producing a return of leg 15 to its normal position. Correspondingly, the pivotal motion of end 73 of arm 70 removes the tension applied to cable 56 allowing spring 86 to again pivot movable jaw 42 to the open position shown in solid-line representation. It will be apparent to those skilled in the art that the motion of movable jaw 42 in response to pivotal movement of leg 15 is continuous and intermediate positions may be attained by movable jaw 42 through movement of leg 15.

In accordance with an important aspect of the present invention, the operative mechanism provided by arm 70 and cable 56 together with springs 86 and 76 allows the pivotal motion of upper arm 31 and the rotational motion of claw 40 to be carried forward without effecting the open or closed position of movable jaw 42 with respect to fixed jaw 41. Thus, as upper arm 31 pivots about shoulder joint 30, the force upon cable 56 is virtually uneffected. Similarly, the rotation of fixed jaw 41 upon claw joint 32 similarly avoids effecting the tension applied to cable 56 in any significant extent. As a result, the user is able to position both upper arm 31 and claw 40 as desired through their entire ranges of motion and is nonetheless to independently actuate the closure of claw 40 solely through manipulation of leg 15. This has been found to provide substantial advantage in increased play value and excitement for the child user and provides substantial improvement in the toy figure.

What has been shown is a toy figure having a grasping claw which is operated in response to pivotal motion of one leg of the toy figure. The claw is rotatably supported upon an upper arm which in turn is pivotally coupled to the torso of the toy figure. The opening and closing action of the grasping claw is independent of the pivotal position of the upper arm and rotational position of the entire claw assembly. The toy figure is largely fabricated in its preferred form of molded plastic components and is relatively simple and inexpensive to manufacture. The mechanism provided is extremely durable and has great resistance to abuse and stressful use by the child user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a body having an interior cavity formed therein;

a plurality of appendages coupled to said body;

first means for pivotally supporting a first one of said appendages upon said body for first and second directions of motion;

second means for pivotally supporting a second one of said appendages upon said body;

a fixed jaw rotatably coupled to said second one of said appendages;

a movable jaw pivotally coupled to said fixed jaw movable between open and closed positions;

first spring means coupled to said fixed jaw and said movable jaw urging said movable jaw toward said open position;

an arm pivotally supported within said interior cavity having a first end coupled to said first one of said appendages and a second end;

a flexible member connected to said movable jaw and said second end of said arm; and second spring means coupled to said arm urging said arm and said first one of said appendages in said first pivotal direction of motion, whereby said movable jaw is moved from said open position toward said closed position as said first one of said appendages is pivoted in said second pivotal direction of motion.

2. A toy figure as set forth in claim 1 wherein said first one of said appendages is a leg and wherein said second one of said appendages is an arm.

3. A toy figure as set forth in claim 2 wherein said plurality of appendages includes at least one more arm and at least one more leg.

4. A toy figure comprising:

a body;

a leg coupled to said body pivotable in first and second directions;

an arm coupled to said body pivotable with respect thereto;

a claw rotatably coupled to said arm having an open position and a closed position and a claw spring urging said claw toward said open position;

a flexible cable coupled to said claw; and operative means coupled to said leg and said flexible cable for drawing said flexible cable and closing said claw when said leg is moved in said first direction and for allowing said claw spring to open said claw when said leg is moved in said second direction.

5. A toy figure as set forth in claim 4 wherein said operative means includes an arm pivotally supported by said body and having a first end coupled to and supporting said leg upon said body and a second end connected to said flexible cable.

6. A toy figure as set forth in claim 5 wherein said operative means further includes an arm spring coupled to said arm and urging said arm in said second direction.

7. A toy figure as set forth in claim 6 wherein said leg is pivotable upon said first end of said arm.

8. A toy figure as set forth in claim 7 further including a second leg and a second arm.

9. A toy figure comprising:

a body;

an arm pivotally supported upon said body;

a claw rotatably supported upon said arm and having open and closed positions;

a leg having a leg support coupled to said body pivotably movable in first and second opposed directions as said leg is moved; and cable means coupled between said claw and said leg support for opening and closing said claw in response to first and second direction movement of said leg support, said cable means being substantially uneffected, as to opening and closing of said claw, by pivotal motion of said arm or rotational motion of said claw.

10. A toy figure as set forth in claim 9 further including spring means for urging said claw toward said open position.

* * * * *